US006840410B2

(12) United States Patent
Dark

(10) Patent No.: US 6,840,410 B2
(45) Date of Patent: Jan. 11, 2005

(54) FLUID DISPENSING VALVE AND METHOD OF USE

(76) Inventor: Richard C. G. Dark, 2248 Gum Tree La., Fallbrook, CA (US) 92028

( * ) Notice: Subject to any disclaimer, the term of this patent is extended or adjusted under 35 U.S.C. 154(b) by 96 days.

(21) Appl. No.: 10/252,924

(22) Filed: Sep. 20, 2002

(65) Prior Publication Data

US 2003/0094467 A1 May 22, 2003

Related U.S. Application Data

(63) Continuation-in-part of application No. 10/005,866, filed on Nov. 8, 2001, now Pat. No. 6,616,012.
(60) Provisional application No. 60/308,332, filed on Jul. 27, 2001.

(51) Int. Cl.[7] ..... B67D 3/00
(52) U.S. Cl. ..... 222/481.5; 222/494
(58) Field of Search ..... 222/212, 213, 222/481.5, 490, 494

(56) References Cited

U.S. PATENT DOCUMENTS

| | | | | |
|---|---|---|---|---|
| 4,442,947 A | | 4/1984 | Banich, Sr. | 215/344 |
| 4,506,809 A | | 3/1985 | Corsette | 137/493 |
| 4,728,006 A | | 3/1988 | Drobish et al. | 222/181 |
| 4,785,978 A | | 11/1988 | Kano et al. | 215/309 |
| 5,005,737 A | | 4/1991 | Rohr | 222/212 |
| 5,169,035 A | | 12/1992 | Imbery, Jr. | 222/212 |
| 5,240,149 A | | 8/1993 | Schmidt | 137/102 |
| 5,271,531 A | | 12/1993 | Rohr et al. | 222/212 |
| 5,390,805 A | | 2/1995 | Bilani et al. | 215/260 |
| 5,447,258 A | * | 9/1995 | Suzuki | 222/494 |
| 5,687,882 A | | 11/1997 | Mueller | 222/212 |
| 5,785,196 A | | 7/1998 | Montgomery | 215/354 |
| 5,842,618 A | | 12/1998 | Julemont et al. | 222/490 |
| 5,862,955 A | | 1/1999 | Albini et al. | 222/212 |
| 5,954,237 A | | 9/1999 | Lampe et al. | 222/153.06 |
| 6,062,436 A | | 5/2000 | Fuchs | 222/212 |
| 6,116,457 A | | 9/2000 | Haberman | 220/703 |
| 6,145,707 A | * | 11/2000 | Baudin | 222/189.09 |
| 6,616,012 B2 | * | 9/2003 | Dark | 222/1 |

* cited by examiner

*Primary Examiner*—Joseph A. Kaufman
(74) *Attorney, Agent, or Firm*—Eric Karich

(57) ABSTRACT

A fluid dispensing valve for controlling the flow of a fluid through a through-conduit has a retainer and a dispensing valve body. The retainer has an upwardly extending plug and is adapted to be inserted into an inner surface of the through-conduit. A dispensing valve body is bounded by an exterior surface, an interior surface, a valve perimeter, and a dispensing orifice perimeter. The dispensing valve body is shaped to fit within the through-conduit such that the valve perimeter forms a sealing relationship with the inner surface, and the dispensing orifice perimeter fits securely around and seals against the upwardly extending plug.

10 Claims, 9 Drawing Sheets

FLUID DISPENSING VALVE AND METHOD OF USE

CROSS-REFERENCE TO RELATED APPLICATIONS

This application for a utility patent is a continuation-in-part of a previously filed utility patent, having the application Ser. No. 10/005,866, filed Nov. 8, 2001 now U.S. Pat. No. 6,616,012. This application also claims the benefit of U.S. Provisional Application No. 60/308,332, filed Jul. 27, 2001.

STATEMENT REGARDING FEDERALLY SPONSORED RESEARCH

Not Applicable

BACKGROUND OF THE INVENTION

1. Field of the Invention

This invention relates generally to fluid dispensing valves, and more particularly to a fluid dispensing valve that includes an overcap that functions to seal the valve until the tamper evident feature is removed.

2. Description of Related Art

Various manufacturers have attempted to develop a valve that is adapted to prevent the flow of a fluid through the valve until the fluid is forced through the valve with a sustained pressure, such as when the container is squeezed by a user, or when the user attempts to suck the fluid from the container. A goal of the valve is to prevent fluid flow when the container is knocked over or inverted, but to allow a large volume of fluid to flow when the user wanted to drink from the container.

The state of the art in this field is described in Dark, U.S. Pat. No. 6,250,503 ("the Dark reference"), hereby incorporated by reference. The Dark reference describes a dispensing closure for controlling the flow of a fluid from a container. The dispensing closure includes a conduit having an interior conduit surface partially blocked by a top retainer and a bottom retainer. The dispensing closure further includes a fluid dispensing valve that includes a resilient dome area and a seal area. The seal area extends outwardly, and preferably downwardly, from the dome perimeter to define a seal perimeter shaped to conform to the interior conduit surface to form a seal when the fluid dispensing valve is operably positioned within the conduit between the top and bottom retainers. At least one rib fixedly connects the seal area to the dome area such that deformation of the dome area is transmitted through the at least one rib to the seal area to disrupt the seal and form at least one dispensing flow path. Air pressure on an exterior seal surface of the seal area causes the seal area to deform between the at least one rib to form at least one venting flow path.

Prior to the Dark reference, various dispensing closures have also been designed to fit on the container for dispensing beverages, liquids, soaps and other fluent materials. Such closures are also often used on a baby drinking cup or cyclist water bottle whereupon the beverage would be dispensed by sucking on the closure or by squeezing the container.

Prior art closures primarily utilize a silicone dome dispensing system whereby the dome is penetrated by a pair of slits. The slits on the prior art domed surfaces open like petals when sufficient force is pushed upon it by the difference in the pressure in the container as compared to the pressure outside the container. Examples of these constructions are taught in Drobish et al., U.S. Pat. No. 4,768,006 and Rohr, U.S. Pat. Nos. 5,005,737 and 5,271,531.

There are several important disadvantages to the prior art construction. First, the slits used in the prior art are not effective in preventing accidental leakage if the container is bumped or dropped. Second, the slits must be added after the rubber dome is molded and therefore require a second operation, which adds to the cost of manufacturing the product.

Another prior art dispensing closure is shown in Imbery, Jr., U.S. Pat. No. 5,169,035. The Imbery, Jr. valve is excellent at venting air back into the container without allowing leakage through the venting flow path; however, the Imbery, Jr. closure does not teach a mechanism to control the outward flow of the fluid through the primary conduit.

Various other mechanisms are taught in Lampe et al., U.S. Pat. No. 5,954,237, Bilani et al., U.S. Pat. No. 5,390,805, Haberman, U.S. Pat. No. 6,116,457, Fuchs, U.S. Pat. No. 6,062,436, Montgomery, U.S. Pat. No. 5,785,196, Banich, Sr., U.S. Pat. No. 4,442,947, and Julemont et al., U.S. Pat. No. 5,842,618.

In order to be effective, the fluid dispensing valve must meet three conditions. First, the valve should not dispense if the container is bumped or accidentally squeezed slightly. Second, the valve should vent and allow air to pass back through it into the container to make up the volume it has dispensed. Third, the valve must be inexpensive to manufacture.

While the valve taught by Dark is presently the preferred mechanism for meeting these objectives, the mechanism disclosed by the Dark reference is sometimes not able to dispense large enough volumes of fluid without using a mechanism that is too large for the container. The remaining prior art does not teach a valve that meets all three requirements of an effective fluid dispensing valve. The present invention fulfills these needs and provides further related advantages as described in the following summary.

The prior art teaches closure mechanisms that provide some of the benefits described above; however, the prior art does not teach a closure mechanism having a valve that meets the requirements described above, and yet still allows a large volume of fluid to flow when required. The present invention fulfills these needs and provides further related advantages as described in the following summary.

SUMMARY OF THE INVENTION

The present invention teaches certain benefits in construction and use which give rise to the objectives described below.

The present invention provides a fluid dispensing valve for controlling the flow of a fluid through a through-conduit. The fluid dispensing valve has a retainer and a dispensing valve body. The retainer has an upwardly extending plug and is adapted to be inserted into an inner surface of the through-conduit. A dispensing valve body is bounded by an exterior surface, an interior surface, a valve perimeter, and a dispensing orifice perimeter. The dispensing valve body is shaped to fit within the through-conduit such that the valve perimeter forms a sealing relationship with the inner surface, and the dispensing orifice perimeter fits securely around and seals against the upwardly extending plug.

A primary objective of the present invention is to provide a fluid dispensing valve having advantages not taught by the prior art.

Another objective is to provide a fluid dispensing valve that closes a container and does not leak if the container is knocked over or inverted.

Another objective is to provide a fluid dispensing valve having a means for biasing the dispensing valve body against the upwardly extending plug so that the fluid dispensing valve does not leak when subjected to minor or momentary jolts, but only dispenses in response to a firm and sustained force.

Another objective is to provide an annular ridge adjacent the dispensing orifice perimeter for enabling the molding of the dispensing valve body so that flash does not impair the sealing ability of the dispensing valve body.

Another objective is to provide an overcap that is adapted close the fluid dispensing valve until a tamper evident feature is broken or otherwise visibly compromised.

A further objective is to provide a locking taper that enables the dispensing valve body to form a sealing relationship with the upwardly extending plug while providing for the greatest range of variance in the diameter of the dispensing orifice perimeter.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
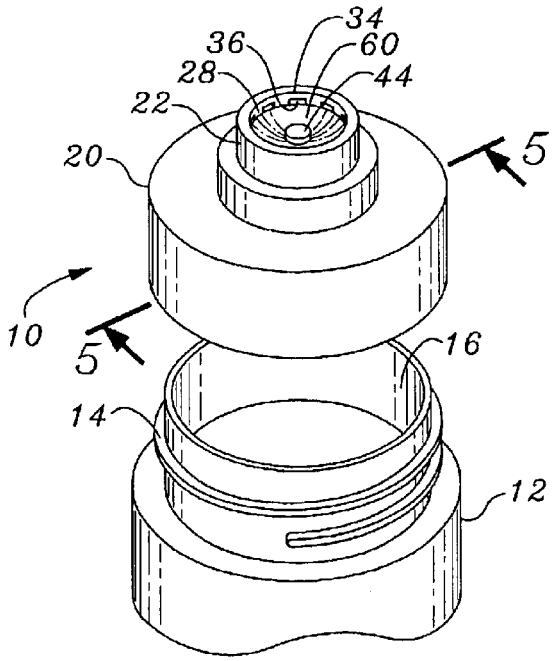
FIG. 1 is a partially exploded perspective view of a first embodiment of the present invention, a fluid dispensing valve that includes a cap and a dispensing valve body.

The above-described drawing figures illustrate the invention, a fluid dispensing valve 10 for controlling the flow of a fluid through a through-conduit 26, typically from a container 12.

As shown in the various figures, the fluid dispensing valve 10 includes a retainer 40, a dispensing valve body 60, and a means for confining the dispensing valve body 60 within the through-conduit 26 adjacent the retainer 40. The dispensing valve body 60 is adapted to be mounted upon an upwardly extending plug 44 of the retainer 40 and positioned to seal the through-conduit 26.

Figure 16:
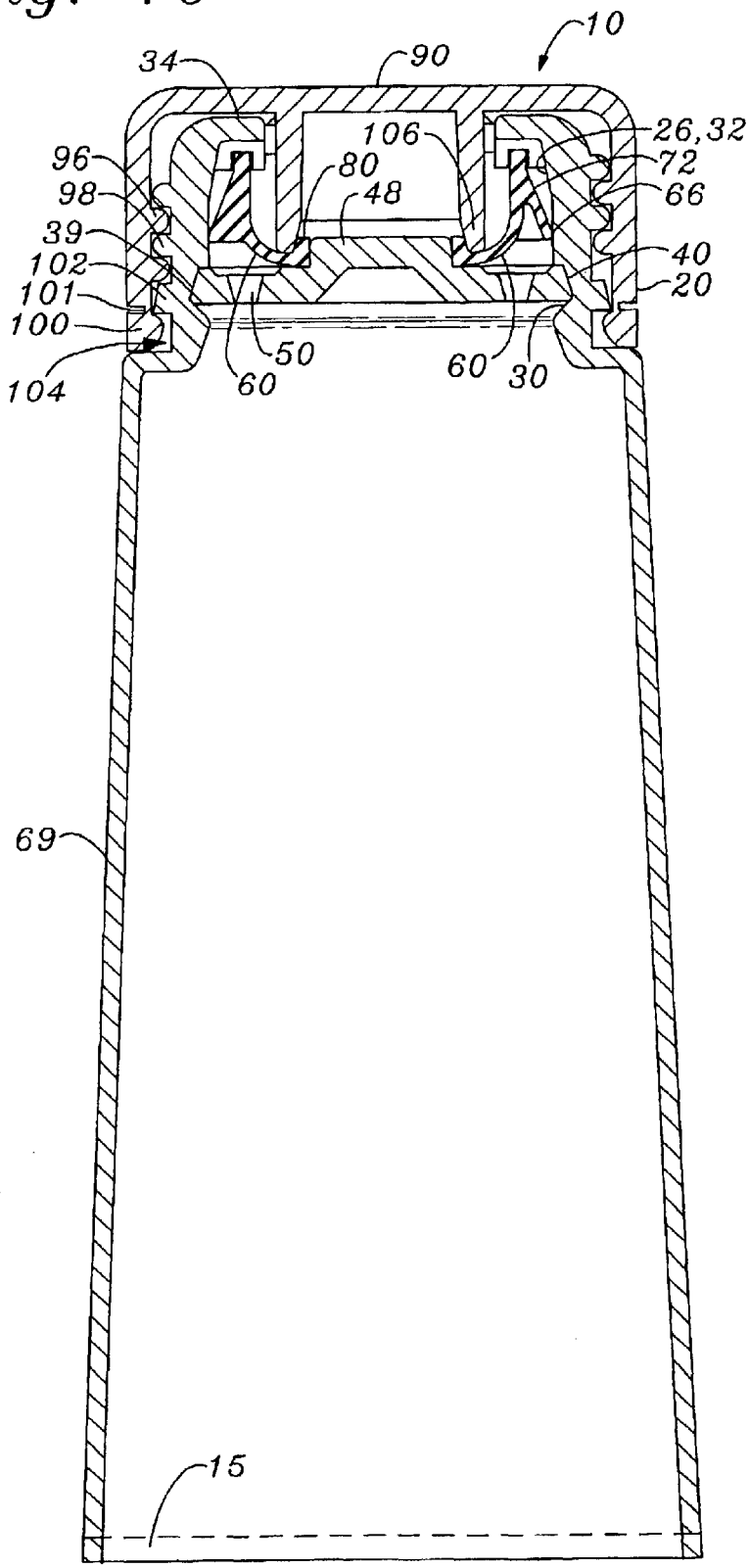
FIG. 16 is a sectional view similar to FIG. 15, illustrating a second embodiment of the overcap mounted upon an injection molded squeezable tube.
Figure 17:
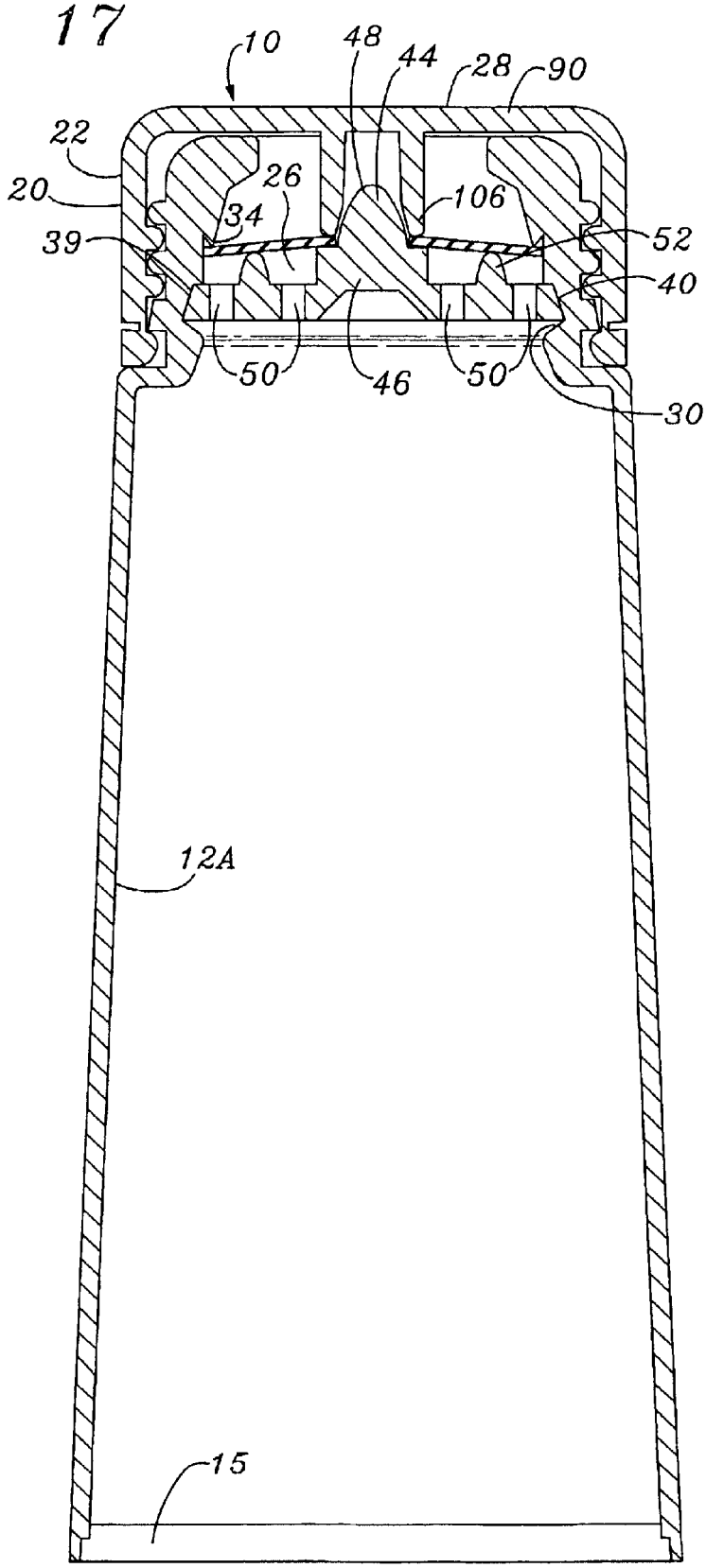
FIG. 17 is a sectional view similar to FIG. 16 wherein the fluid dispensing valve includes the second embodiment of the dispensing valve body and wherein the container includes an open bottom.
Figure 19:
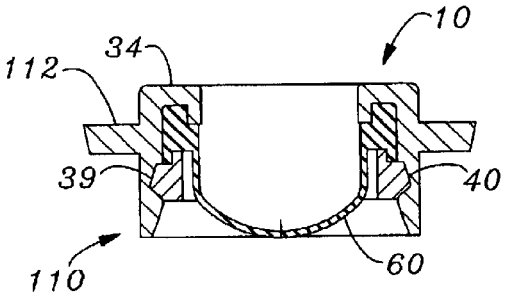
FIG. 19 is a sectional view of yet another alternative embodiment thereof.
Figure 18:
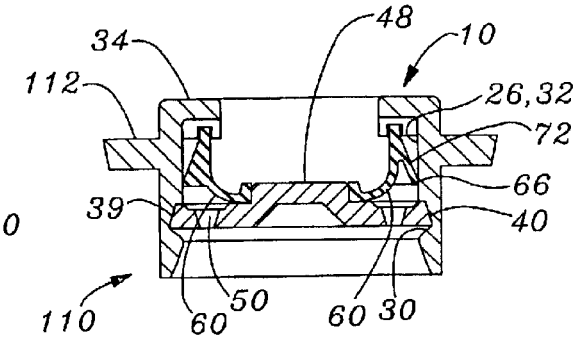
FIG. 18 is a sectional view of an alternative embodiment of the fluid dispensing valve wherein the through-conduit is a valve subassembly.

In some of the embodiments, as shown in FIGS. 1, 5–8, and 11–15, the fluid dispensing valve 10 is part of a cap 20 that is adapted to be mounted on the container 12. In another embodiment, as shown in FIG. 16, the fluid dispensing valve 10 is part of an injected molded squeezabe tube 69. In another embodiment, as shown in FIG. 17, the fluid dispensing valve 10 is part of a cylindrical container 12A that has an open bottom 15. In yet another embodiment, as shown in FIGS. 18–23, the fluid dispensing valve 10 is part of a valve subassembly 110 that is adapted to be inserted into the container 12 as a separate component.

In any case, the fluid dispensing valve 10 is adapted to contain the fluid despite the inversion of the container 12, and despite momentary shocks that might otherwise cause the fluid to flow through the fluid dispensing valve 10 and out of the container 12. However, in response to a sustained pressure, such as when the container 12 is squeezed by a user, or when the user attempts to suck the fluid from the container 12, the fluid dispensing valve 10 changes conformation to allow a large volume of the fluid to flow through the fluid dispensing valve 10 and from the container 12 with minimal effort.

First Embodiment

In a first embodiment, as shown in FIGS. 1 and 5–8, the through-conduit 26 has a top opening 28, a bottom opening 30, and an inner surface 32 therebetween that is shaped to receive the dispensing valve body 60 as described below. The through-conduit 26 of this embodiment is defined by the spout 22 of the cap 20.

The cap 20 is adapted to engage the container 12 to close a container opening 16 of the container 12. The cap 20 includes a means for attaching the cap 20 to the container 12 so that the cap 20 covers and seals the container opening 16. In one embodiment of the means for attaching, the cap 20 includes an internally threaded portion 24 that is shaped to threadedly engage an externally threaded portion 14 of the container 12. The externally threaded portion 14 is positioned around the container opening 16, so that threaded engagement of the cap 20 to the externally threaded portion 14 functions to close the container opening 16. Obviously, while a threaded engagement is one option, alternative embodiments could be designed by those skilled in the art, including but not limited to lips, flanges, fissures, or other shapes (not shown) that enable a snap-fit and/or frictional engagement, joining the two with an adhesive or heat weld, or any other method of attachment that can be devised by one skilled in the art. The cap 20 is preferably constructed of injection molded plastic, although any similar or equivalent material could be used.

In one embodiment, the means for confining the dispensing valve body 60 within the through-conduit 26 adjacent the retainer 40 is an inner flange 34 that is integral with the cap 20 and extends inwardly adjacent the top opening 28 to hold the dispensing valve body 60 within the through-conduit 26 of the spout 22 and prevent it from falling out of the top opening 28. In one embodiment, the inner flange 34 includes a retaining rim 38 that functions to hold the dispensing valve body 60 in its correct position. The inner flange 34 and the retaining rim 38 preferably also include at least one venting aperture 36 that enables air to vent into the container 12 without being blocked by the dispensing valve body 60; however, a similar or inverse structure in the dispensing valve body 60, such as an upwardly extending portion (not shown), could serve this same function as the at least one venting aperture 36, and such alternatives should be considered within the scope of the claimed invention.

While the inner flange 34 is a preferred embodiment, the means for containing could be formed by an alternative structure. Any form of retaining ring, webbing, or similar support structure cold be used. Furthermore, the means for containing could be integral with the through-conduit 26 (as with the inner flange 34), or the means for containing could be attached to the through-conduit 26, either snapping into place, threadedly engaging the through-conduit 26, being glued or bonded into place, or otherwise fixed or attached into position. Obviously, many alternatives can be devised by those skilled in the art to accomplish this same objective.

Dispensing Valve Body

Common to all of the embodiments, as shown in the various drawing figures, the dispensing valve body 60 is bounded by an exterior surface 62, an interior surface 64, a valve perimeter 66, and a dispensing orifice perimeter 68 that defines a flow orifice 67. The dispensing valve body 60 is shaped to be mounted upon the upwardly extending plug 44 and inserted through the bottom opening 30 and into the through-conduit 26 of the spout 22, thereby selectively sealing the through-conduit 26. The dispensing orifice perimeter 68 is shaped to fit securely around and seal against the upwardly extending plug 44. The valve perimeter 66 is shaped to fit within the spout 22 and form a sealing relationship with the inner surface 32 or equivalent surface. The inner surface 32 can include part of the retainer 40 or the inner flange 34 because the dispensing valve body 60 could potentially form a sealing relationship with components of any of these elements; however, the seal is preferably against the inner surface 32 of the spout 22 itself, as shown in both of the illustrated embodiments.

The dispensing valve body 60 is preferably constructed of a resilient material such as a molded rubber, silicone, or plastic. The thickness, flexibility, and other physical characteristics of the dispensing valve body 60 will vary depending upon the flow characteristics desired and the viscosity of the fluid being dispensed. The dispensing valve body 60 of the present preferred embodiment is constructed of silicone having a hardness of durometer 50 shore, A scale.

Figure 2:
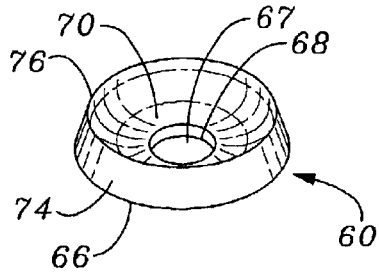
FIG. 2 is a top perspective view of the dispensing valve body used therein.
Figure 3:
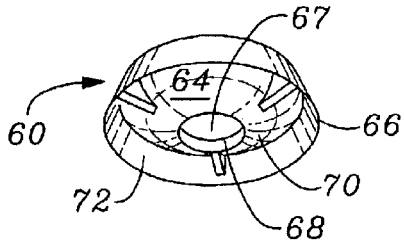
FIG. 3 is a bottom perspective view thereof.
Figure 6:
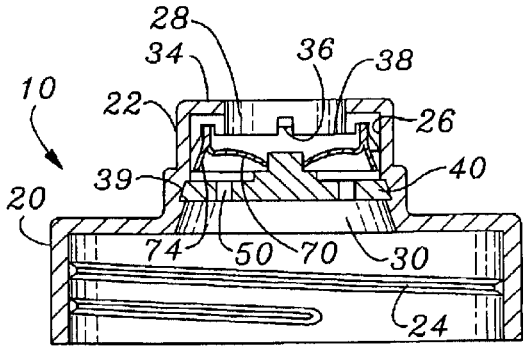
FIG. 6 is a sectional view thereof taken along line 5—5 in FIG. 1, illustrating the dispensing valve body moving from the sealed conformation towards a dispensing conformation.
Figure 7:
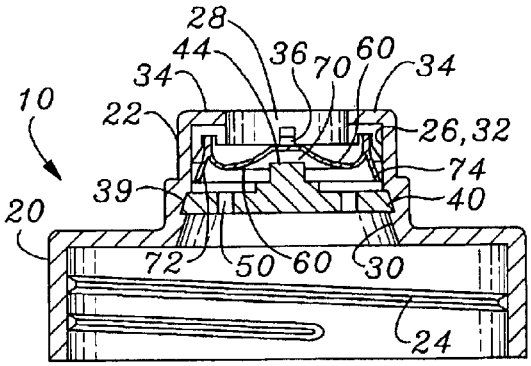
FIG. 7 is a sectional view thereof taken along line 5—5 in FIG. 1, illustrating the dispensing valve body in the dispensing conformation.

In a first embodiment, shown in FIGS. 2–3, the dispensing valve body 60 includes an interior portion 70 of the dispensing valve body 60, adjacent the dispensing orifice perimeter 68, that is formed of a resilient material that can change conformation from a sealed conformation to a dispensing conformation. In the sealed conformation, shown in FIG. 5, the dispensing orifice perimeter 68 is positioned securely around and sealed against the upwardly extending plug 44. As shown in FIG. 6, the interior portion 70 changes from the sealed conformation to the dispensing conformation when the pressure against the interior surface 64 exceeds the pressure against the exterior surface 62. In the dispensing conformation, as shown in FIG. 7, the dispensing orifice perimeter 68 is lifted out of sealing contact with the upwardly extending plug 44. Once the dispensing orifice perimeter 68 is lifted out of contact with the upwardly extending plug 44, the fluid is able to flow freely through the flow orifice 67. Since the flow orifice 67 can be made quite large, this can enable a large volume of fluid flow, or flow a thick fluid, without restriction.

Figure 8:
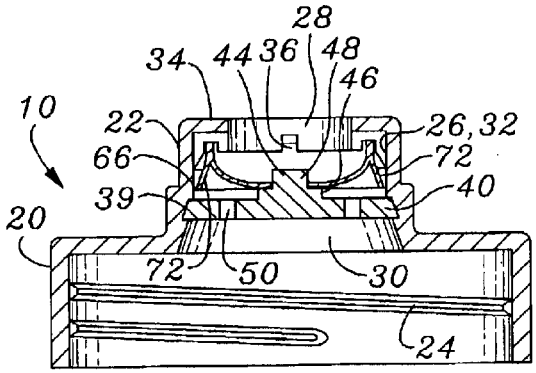
FIG. 8 is a sectional view thereof taken along line 5—5 in FIG. 1, illustrating the dispensing valve body in a venting conformation.
Figure 11:
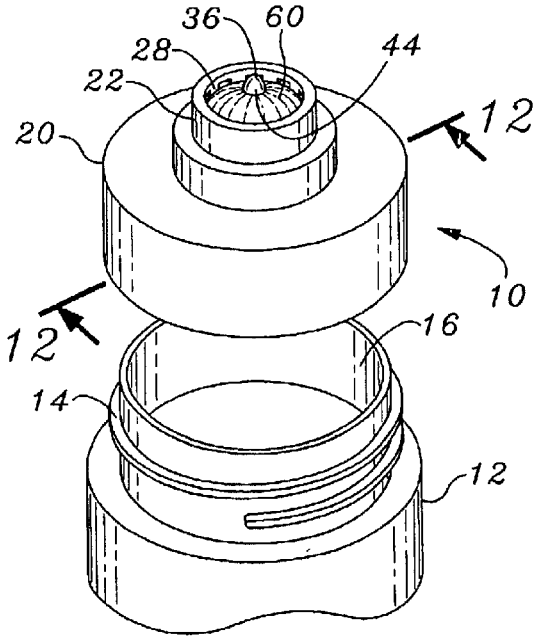
FIG. 11 is a partially exploded perspective view of a second embodiment of the fluid dispensing valve.

As shown in FIGS. 2–3, the dispensing valve body 60 further includes an exterior portion 72, adjacent the valve perimeter 66, that is formed of a resilient material that can change conformation from an initial conformation to a venting conformation. In the initial conformation, shown in FIG. 5, the valve perimeter 66 is positioned securely around and sealed against the inner surface 32 to prevent the fluid from leaking around the dispensing valve body 60. As shown in FIG. 8, when the pressure against the exterior surface 62 exceeds the pressure against the interior surface 64, the exterior portion 72 is pushed to the venting conformation in which the valve perimeter 66 is out of sealing contact with the inner surface 32.

In the first embodiment, shown in FIGS. 1–8, the exterior portion 72 is formed by a venting flange 74 that extends outwardly and downwardly from a connection ridge 76 formed by the integral joining of the venting flange 74 and the interior portion 70. The connection ridge 76 is shaped to contact the inner flange 34 between the retaining rim 38 and the inner surface 32 and thereby hold the dispensing valve body 60 in its correct position. The at least one venting aperture 36 allows air to vent past the connection ridge 76.

The angle of the venting flange 74 with respect to the inner surface 32 facilitates insertion of the dispensing valve body 60 into the spout 22, and further facilitates venting because the venting flange 74 can hinge along the connection ridge 76. In one embodiment, as shown in FIG. 3, the exterior portion 72 includes a plurality of ribs 65. The plurality of ribs 65 function to hold the venting flange 74 in its proper position and shape.

Retainer (First Embodiment)

Figure 4:
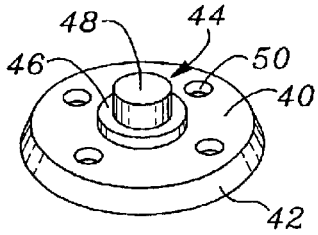
FIG. 4 is a top perspective view of a retainer used therein.

As shown in FIG. 4, the retainer 40 of the first embodiment is a generally disk-shaped component that is constructed of a strong, rigid material such as plastic. The retainer 40 includes an upwardly extending plug 44 and at least one flow aperture 50 through the retainer 40. The upwardly extending plug 44, illustrated in FIGS. 1, 4, and 5–8, is preferably positioned at the center of the disk and includes a plug shoulder 46 and an upwardly extending portion 48. The upwardly extending portion 48 is shaped to fit through the flow orifice 67 to seal the dispensing valve body 60. The dispensing valve body 60 abuts to the plug shoulder 46, which serves to further seal the dispensing valve body 60 as well as support the dispensing valve body 60 in its correct position, also described in greater detail below.

Figure 10:
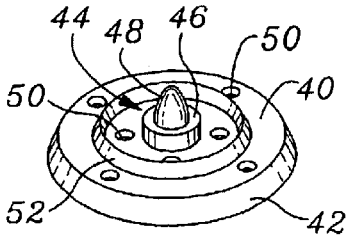
FIG. 10 is a top perspective view of a second embodiment of the retainer.

The upwardly extending portion 48 can be generally cylindrical, as shown in FIG. 4; or the upwardly extending portion 48 can have an alternative shape, including but not limited to a conical shape as shown in FIG. 10. While these shapes are currently preferred, this should not be construed to limited the invention to these shapes, and those skilled in the art can utilize alternative shapes, and such alternatives should be considered within the scope of the claimed invention. The shape of the upwardly extending portion 48 is discussed in greater detail below. The combination of the dispensing valve body 60 and the upwardly extending plug 44 enables the fluid dispensing valve 10 to dispense either large or small volumes of fluid from the container 12, and also enables the fluid dispensing valve 10 to dispense fluids of a wide range of viscosities, including "thick" fluids such as shampoo, liquid soap, and ketchup.

As shown in FIGS. 4 and 5–8, in the first embodiment, the at least one flow aperture 50 of the retainer 40 includes a plurality of apertures that are disposed around the upwardly extending plug 44 to allow the fluid to flow out of the container 12 and be dispensed through the fluid dispensing valve 10, and then allow air to vent back into the container 12. In a second embodiment, as shown in FIGS. 10 and 12–14, the at least one flow aperture 50 includes a plurality of apertures, some of which must be located on either side of a support ridge 52, described below, so that fluid can flow through one side of the support ridge 52 and air can vent through the other.

Figure 5:
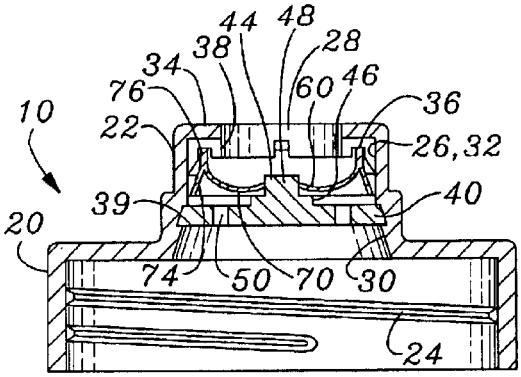
FIG. 5 is a sectional view thereof taken along line 5—5 in FIG. 1, illustrating the dispensing valve body in a sealed conformation.

As shown in FIG. 5, the dispensing valve body 60 is positioned within the through-conduit 26, as described in greater detail below, and locked into place with the retainer 40. The retainer 40 preferably includes a retainer perimeter 42 that is adapted to engage the through-conduit 26 adjacent the bottom opening 30. In one embodiment, the retainer perimeter 42 is shaped and tapered to frictionally engage an annular recess 39 located adjacent the bottom opening 30. The annular recess 39 is shaped to receive the retainer perimeter 42 and lock it in place. Alternative mechanisms can be used to lock the retainer 40 within the through-conduit 26, such as a threaded engagement, an adhesive, welding, or by injection molding the retainer 40 as an integral part of the through-conduit 26, and such alternative mechanisms should be considered within the scope of the claimed invention; however, the use of the annular recess 39 described is preferred because it makes installation of the retainer 40 quick and easy, and it locks the retainer 40 within the through-conduit 26 with such strength that it is extremely difficult to ever remove the retainer 40 once it has been installed. Such a strong connection is useful in the present invention because otherwise the retainer 40 might pose a choking hazard to a user drinking from the container 12.

Second Embodiment

Figure 9:
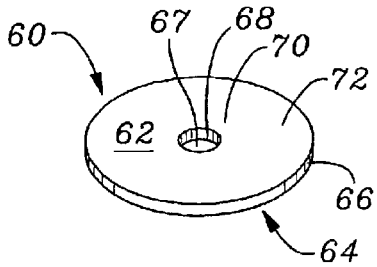
FIG. 9 is a top perspective view of a second embodiment of the dispensing valve body.

A second embodiment of the fluid dispensing valve 10 is shown in FIGS. 9–14. In this embodiment, the dispensing valve body 60 is generally flat and disk-shaped, as shown in FIG. 9. To enable the function of the fluid dispensing valve 10 when the dispensing valve body 60 is flat, the retainer 40, shown in FIG. 10, includes a support ridge 52. The support ridge 52 is preferably an annular ridge that is positioned concentrically around the upwardly extending plug 44.

Figure 12:
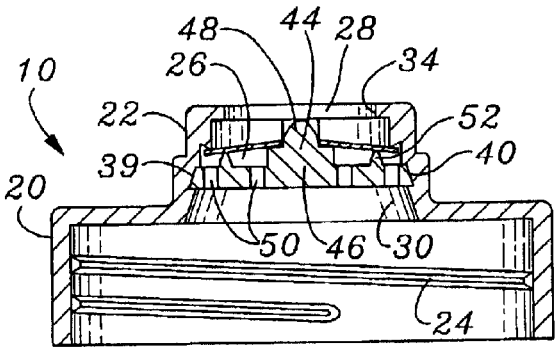
FIG. 12 is a sectional view thereof taken along line 12—12 in FIG. 11, illustrating the second embodiment of the dispensing valve body in the sealed conformation.

As shown in FIG. 12, the support ridge 52 functions to support the dispensing valve body 60 so that the valve perimeter 66 properly contacts the inner surface 32 to form a seal, and so that the dispensing orifice perimeter 68 contacts the upwardly extending plug 44 to form a seal. The exterior portion 72 preferably also contacts the inner flange 34, further improving the seal between the dispensing valve body 60 and the through-conduit 26. In this embodiment, the plug shoulder 46 preferably extends upwardly past the inner flange 34, so that the upward pressure of the plug shoulder 46 biases the exterior portion 72 towards the inner flange 34, thereby increasing the strength of the seal formed.

Figure 13:
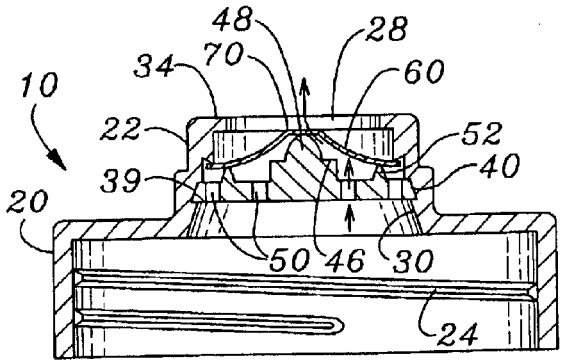
FIG. 13 is a sectional view thereof taken along line 12—12 in FIG. 11, illustrating the second embodiment of the dispensing valve body in the dispensing conformation.
Figure 14:
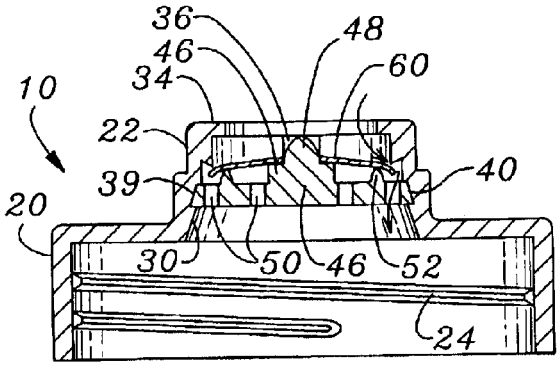
FIG. 14 is a sectional view thereof taken along line 12—12 in FIG. 11, illustrating the second embodiment of the dispensing valve body in the venting conformation.

The support ridge enables the dispensing valve body 60 to flex freely in two directions. First, when the user squeezed the container 12, the interior portion 70 can flex upwardly and thereby lift off of the upwardly extending plug 44, as shown in FIG. 13. Second, the exterior portion 72 can flex downwardly, as shown in FIG. 14, so that the valve perimeter 66 moves away from the inner surface 32 and air can vent back into the container 12.

It is worth noting that any features added to either the cap 20 or the retainer 40 can also be provided, in inverse, on the dispensing valve body 60, and such an inversion should be considered within the scope of the claimed invention. For example, instead of providing the support ridge 52 shown, the dispensing valve body 60 itself might be constructed with an equivalent projecting structure (not shown) which would serve the same function as the support ridge 52. Such inverse structures are within the scope of the claimed invention.

Annular Ridge for Improved Seal

Figure 15:
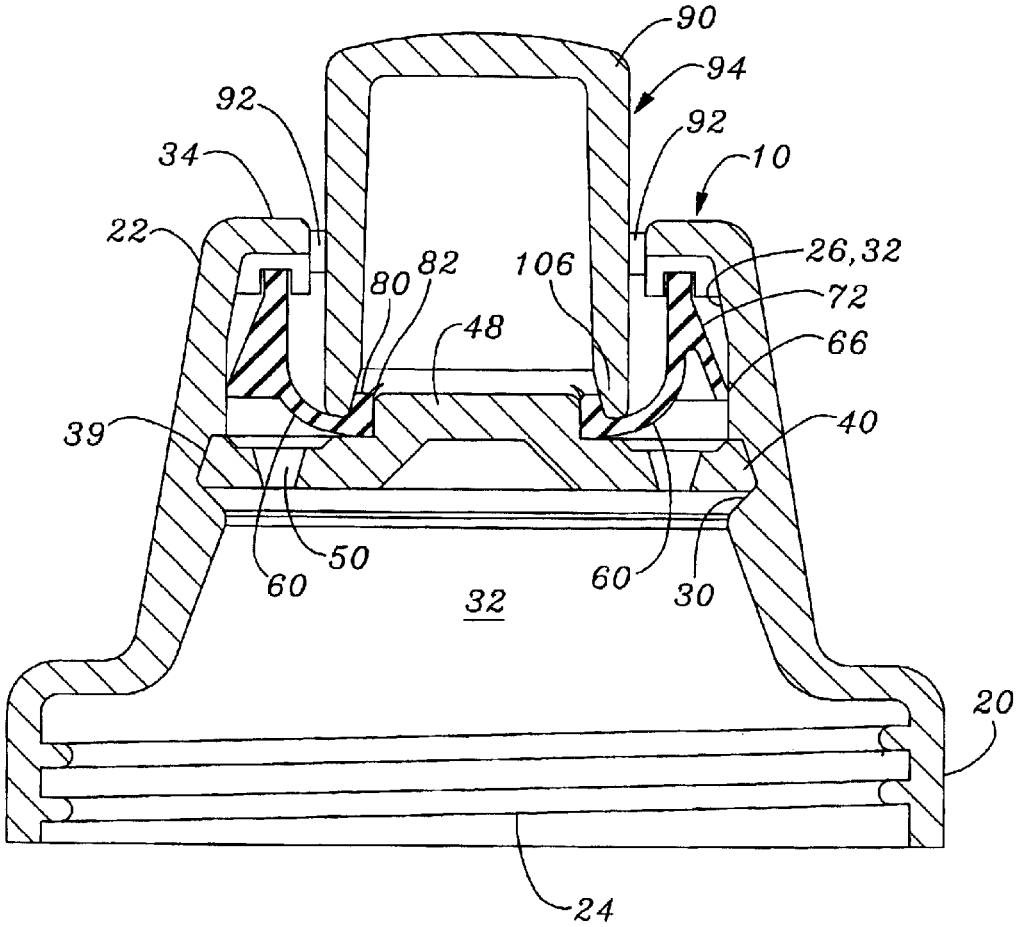
FIG. 15 is a sectional view similar to FIG. 5, illustrating a first embodiment of an overcap positioned on the cap.

In a preferred embodiment, as shown in FIG. 15, the dispensing valve body 60 includes an annular ridge 80 extending upwardly from the exterior surface 62 adjacent the dispensing orifice perimeter 68. The annular ridge 80 is shaped and disposed so that it does not interfere with the seal formed between the dispensing orifice perimeter 68 and the upwardly extending plug 44.

The annular ridge 80 is important during the molding process because it ensures that the dispensing orifice perimeter 68 does not have any flash 82 that might interfere with the seal.

If there is any flash 82 formed as a result of the molding process, as shown in FIG. 15, the flash 82 extends from the annular ridge 80 rather than from the dispensing orifice perimeter 68.

Locking Taper

Figure 24:
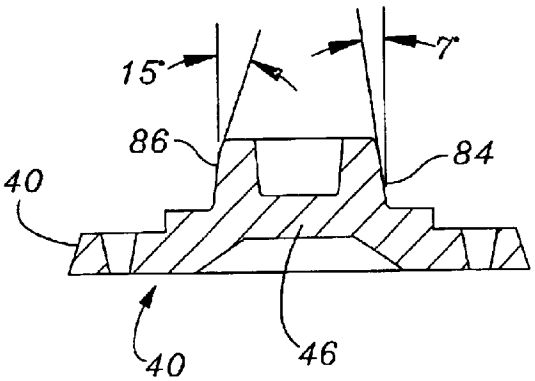
FIG. 24 is a sectional view of a preferred embodiment of the retainer illustrating a locking taper portion and a lead-in taper portion of the upwardly extending plug.

As shown in FIG. 24, the upwardly extending portion 48 of the upwardly extending plug 44 preferably includes a locking taper portion 84 adjacent the plug shoulder 46 that has a locking taper. The locking taper portion 84 is useful because it enables the upwardly extending plug 44 to fit within the flow orifice 67 and seal against the dispensing orifice perimeter 68 despite small variances in the size of the dispensing orifice perimeter 68. The term "locking taper" is hereby defined as a taper that is large enough to provide for the largest possible range of variance, while still maintaining the ability to resist the movement of the dispensing orifice perimeter 68 off of the upwardly extending portion 48. The locking taper portion 84 preferably has a taper of approximately 0.5%–10%, more preferably approximately 3–8%, and most preferably approximately 7%. The locking taper portion 84 preferably extends 0.05–0.09 inches, and most preferably extends approximately 0.074 inches above the plug shoulder 46.

The taper can either be constant or variable over the length of the locking taper portion 84. The locking taper portion 84 should be considered to have a 7% taper if at least one substantial portion of the locking taper portion 84 has a 7% taper with respect to the axis of the through-conduit 26, regardless of whether some of the surrounding areas have another angle of taper. A portion is substantial if it is large enough to function as described herein to receive the dispensing orifice perimeter 68.

The dispensing orifice perimeter 68 is shaped to fit securely around and form a locking seal against the locking taper portion 84 of the upwardly extending plug 44. The term "locking seal" means that the seal formed tends to persist, with friction holding the dispensing orifice perimeter 68 on the upwardly extending plug 44. The locking seal functions to maintain the fluid dispensing valve 10 closed against outside forces until the pressure against the dispensing valve body 60 is great enough, and sustained long enough, to overcome the friction and drag the dispensing orifice perimeter 68 off of the upwardly extending plug 44.

Above the locking taper portion 84, the upwardly extending portion 48 preferably includes a lead-in taper portion 86 that includes a lead-in taper. A "lead-in taper" is hereby defined as a taper that is great enough to facilitate the movement of the upwardly extending portion 48 into the flow orifice 67. The lead-in taper is preferably at least 5%, more preferably at least 8%, and most preferably approximately 15%. The taper percentage is determined as described above.

Figure 25:
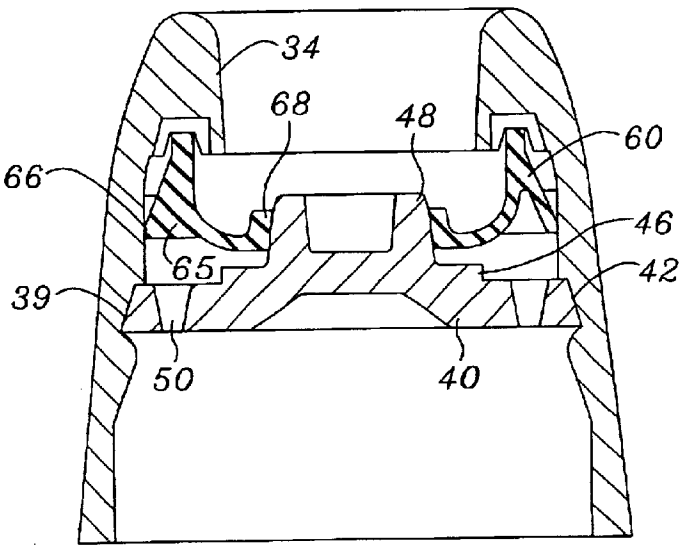
FIG. 25 is a sectional view of the fluid dispensing valve illustrating how the dispensing valve body fits onto the locking taper portion of the upwardly extending plug despite the dispensing orifice perimeter having a smaller diameter than part of the upwardly extending plug.

One benefit of the locking taper portion 84, as described above, is that the dispensing orifice perimeter 68 can fit on the upwardly extending plug 44 even if the diameter of the dispensing orifice perimeter 68 is slightly too large or too small. As shown in FIG. 25, the diameter of the dispensing orifice perimeter 68 is preferably sized to fit around the upwardly extending plug 44 about half of the way down the locking taper portion 84. If the dispensing orifice perimeter 68 is slightly too large, the dispensing orifice perimeter 68 will seat further down the upwardly extending plug 44, as shown in FIG. 15. If the dispensing orifice perimeter 68 is slightly too small, it will seat further up the upwardly extending plug 44. In any case, the dispensing orifice perimeter 68 will form a tight, sealing relationship with the upwardly extending plug 44.

Means for Biasing

The fluid dispensing valve 10 preferably includes a means for biasing the dispensing orifice perimeter 68 downwardly against the upwardly extending plug 44. The means for biasing is preferably provided by the relative positions of the inner flange 34 and the plug shoulder 46 (or the retainer 40 itself if the plug shoulder 46 is not used). For purposes of this application, and for reasons of simplicity and clarity, the term plug shoulder 46 should be considered to include the area of the retainer 40 adjacent the upwardly extending plug 44 even if this area is not raised. The distance between the plug shoulder 46 and the inner flange 34 is less than the height of the dispensing valve body 60, so that the dispensing valve body 60 is at least partially compressed between the plug shoulder 46 and the inner flange 34.

The position of the plug shoulder 46 relative to the inner flange 34 will vary relative to the shape of the dispensing valve body 60. Thus, when the dispensing valve body 60 is flat, as with the second embodiment shown in FIGS. 9–14, the plug shoulder 46 physically extends past the inner flange 34; however, if the dispensing valve body 60 is curved, as with the first embodiment shown in FIGS. 1–8, the plug shoulder 46 does not have to extend physically past the inner flange 34, but extends only far enough to bias the dispensing valve body 60 against the inner flange 34.

Alternative structures can be devised by those skilled in the art that are equivalent to the structures described. For example, a spring (not shown) could be used to press the dispensing valve body 60 against the plug shoulder 46; or, alternative structures could be devised to utilize the resilience of the dispensing valve body 60 to provide a downward bias of the dispensing valve body 60 against the plug shoulder 46. These and other alternatives should be considered within the scope of the claimed invention.

In this same manner, the venting flange 74 preferably has a diameter that is slightly larger than the diameter of the through-conduit 26. This causes the venting flange 74 to be compressed at least slightly when the dispensing valve body 60 is inserted into the through-conduit 26, and the resilience of the dispensing valve body 60 provides a natural bias of the venting flange 74 against the through-conduit 26.

Overcap

In some embodiments, as shown in FIGS. 15–17, the fluid dispensing valve 10 also includes an overcap 90. The overcap 90 is adapted to be attached to cover the through-conduit 26 and preferably includes a tamper evident feature so that it will be readily apparent to a user whether the container 12 has been opened or otherwise the subject of tampering. In the preferred embodiment, the overcap 90 is associated with the through-conduit 26 through a tamper evident attachment feature that only enables the overcap 90 to be removed from the through-conduit 26 by breaking the tamper evident feature. In another embodiment, the overcap 90 is covered with a plastic seal (not shown) that must be broken before the overcap 90 can be removed.

In one embodiment, shown in FIG. 15, the overcap 90 includes a tamper evident connection webbing 92 that breakably connects the overcap 90 with the through-conduit 26. The connection webbing 92 preferably connects an overcap exterior surface 94 to the through-conduit 26 adjacent the inner flange 34. In use, the user simply grasps the overcap 90, twists to break the connection webbing 92, and then removes the overcap 90. The visible breaks in the connection webbing 92 make it readily apparent to the potential consumer that the overcap 90 has already been removed.

In another embodiment, shown in FIGS. 16 and 17, the overcap 90 includes an internal thread 96 that is adapted to engage an external thread 98 of the through-conduit 26 so that the overcap 90 can be threadedly engaged upon the through-conduit 26. In this embodiment, the overcap 90 further includes a tamper evident ring 100 that is attached to the overcap 90 with a tamper evident webbing 101. When the overcap 90 is threadedly mounted upon the through-conduit 26 during assembly of the fluid dispensing valve 10, the tamper evident ring 100 is adapted to snap over an annular locking ridge 102 extending from an outer surface 104 of the through-conduit 26.

As shown in FIGS. 15–17, the overcap 90 preferably includes a locking member 106 that extends downwardly from the overcap 90. The locking member 106 is shaped to compress the dispensing valve body 60 against the retainer when the overcap 90 is engaged with the through-conduit 26. The locking member 106 is typically an annular sidewall; however, if the upwardly extending plug 44 had a cross-section that was not round, the locking member 106 would have a corresponding shape. The locking member 106 is useful for containing the contents of the container 12, especially carbonated drinks which otherwise might open the fluid dispensing valve 10 with the outward pressure they create within the container 12.

FIG. 16 also serves to illustrate another type of commercial embodiment wherein the fluid dispensing valve 10 is associated with an injection molded squeezable tube 69. The injection molded squeezable tube 69 is filled from an open bottom 15 so a cap 20 is not required. Once the injection molded squeezable tube 69 has been filled, it can be heat sealed or otherwise closed to seal the fluid, such as toothpaste, inside the injection molded squeezable tube 69.

In FIG. 17, the fluid dispensing valve 10 is associated with a cylindrical container 12A. The cylindrical container 12A is also filled from the open bottom 15 so the cap 20 is not required. Once the cylindrical container 12A has been filled, a bottom panel (not shown) can be heat or spin welded to cover the open bottom 15 to seal the fluid inside the cylindrical container 12A.

Valve Subassembly

In the embodiments shown in FIGS. 15–17, the through-conduit 26 is an integral part of the cap 20, or the container 12 itself, as described above. In these embodiments, the container 12 must be filled from the bottom, or the container 12 must be filled and then the cap 20 added after the filling process. In alternative embodiments, it is also possible to devise a valve subassembly 110 in which the through-conduit 26 is not part of the cap 20 or the container 12, but wherein the through-conduit 26 is adapted to be inserted into the container 12 after the filling process. The valve subassembly 110 then snaps into the container 12 and becomes fixed in place, but only once the filling process is complete.

Examples of this construction are shown in FIGS. 18–23. In these embodiments, the valve subassembly 110 includes a means for engaging the through-conduit 26 with the container 12. The means for engaging is preferably an annular locking flange 112 that extends outwardly from the through-conduit 26. The is adapted to engage an annular groove 114 of the container 12 to lock the valve subassembly 110 inside the container 12. The means for engaging can be provided by alternative structures, including a threaded engagement, a plurality of locking elements of the through-conduit 26 that are adapted to engage mating locking elements of the container 12, and other equivalent locking mechanisms equivalent to the listed structures or well known to those who are skilled in the art.

Figure 20:
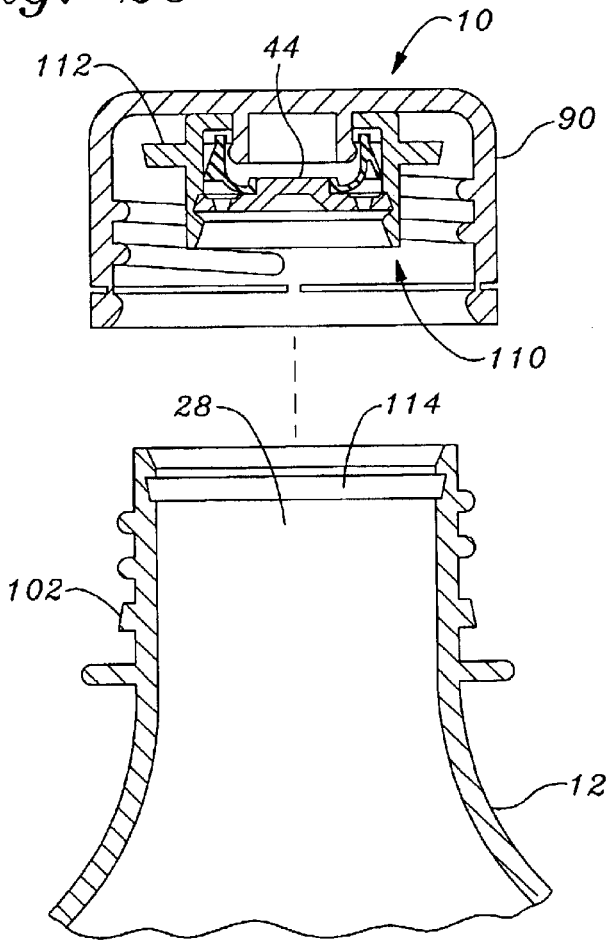
FIG. 20 is an exploded sectional view of a cap that is removably engaged with one embodiment of the valve subassembly, the cap being positioned to be engaged with the container.
Figure 22:
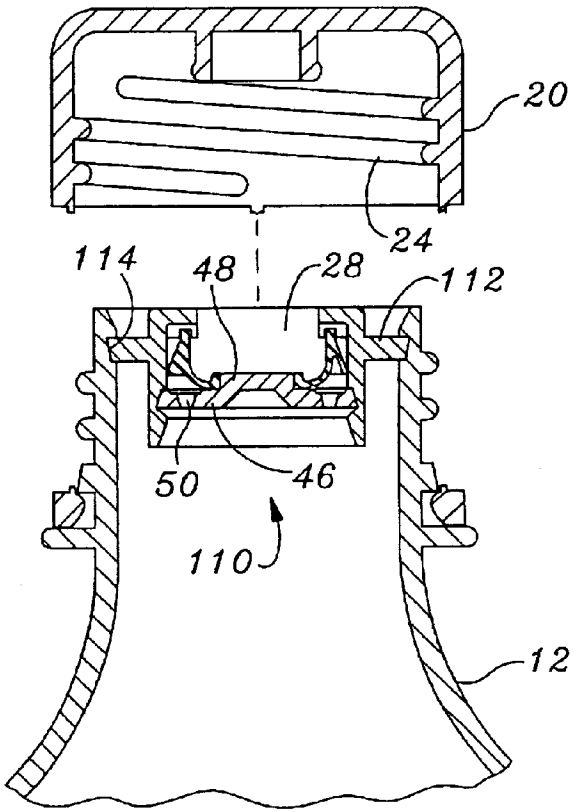
FIG. 22 is a sectional view thereof illustrating the container and the cap once the cap has been removed from the container leaving the valve subassembly attached to the container.
Figure 21:
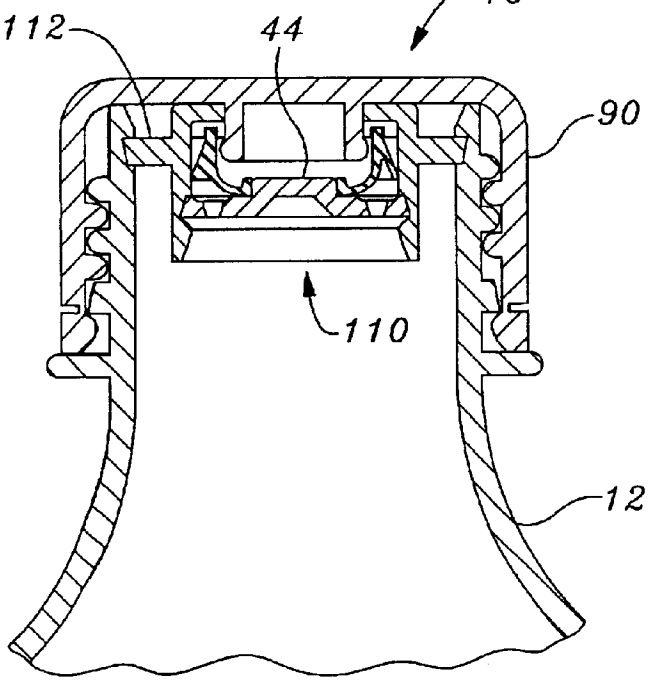
FIG. 21 is a sectional view thereof illustrating the cap and the valve subassembly once they have been attached to the container.
Figure 23:
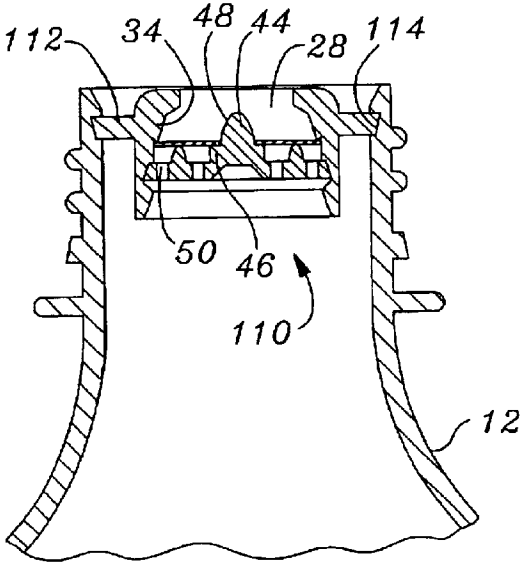
FIG. 23 is a sectional view of the container with an alternative embodiment of the valve subassembly contained therein.

As shown in FIG. 20, the valve subassembly 110 is initially mounted within the cap 20. The cap 20 is mounted on the container 12 during assembly, and in the process the valve subassembly 110 is positioned within the container 12 so that the means for engaging is able to lock the valve subassembly 110 within the container 12. In the preferred embodiment, the annular locking flange 112 snaps into the annular groove 114 of the container 12. As shown in FIG. 22 and 23, the annular locking flange 112 holds the valve subassembly 110 inside the container 12 even when the cap 20 is removed.

Method of Manufacture

During manufacture of the fluid dispensing valve 10, the cap 20, the retainer 40, and the dispensing valve body 60 are preferably injection molded as described above. The dispensing valve body 60 is mounted upon the retainer 40 such that the upwardly extending portion 48 is inserted through the flow orifice 67 formed by the dispensing orifice perimeter 68, and such that the dispensing valve body 60 rests upon the plug shoulder 46. The retainer 40 is then positioned adjacent the bottom opening 30 such that the dispensing valve body 60 is positioned within the cap 20. The retainer 40 is then locked onto the cap 20, preferably by pushing the retainer 40 into the bottom opening 30 until the retainer perimeter 42 snaps into the annular recess 39. Once the retainer 40 is locked into place, it is very difficult to remove, thereby preventing the fluid dispensing valve 10 from coming apart after assembly. The fluid dispensing valve 10 is then attached to the container 12, preferably by threadedly mounting the cap 20 into the container 12.

Once assembled, the container 12 can be inverted and the fluid dispensing valve 10 will prevent any of the fluid in the container 12 from escaping. The fluid dispensing valve 10 will even prevent leakage if the container 12 is subjected to a jolt, such as if the container 12 falls onto the ground. Short periods of pressure are absorbed by the resilience of the dispensing valve body 60 while the dispensing valve body 60 remains seated upon the upwardly extending portion 48 of the upwardly extending plug 44.

If a sustained pressure is exerted upon the fluid, such as by squeezing the container 12 or sucking on the spout 22, the pressure causes the dispensing valve body 60 to slide off of the upwardly extending portion 48 and move from the sealed conformation to the dispensing conformation. While the claims speak in terms of squeezing the container 12, this is expressly considered to include equivalent procedures such as sucking on the spout 22 or otherwise raising the pressure within the container 12 or lowering the pressure outside the fluid dispensing valve 10. Once in the dispensing conformation, fluid can flow through the flow orifice 67. The flow orifice 67 can be made fairly large without impairing the ability of the fluid dispensing valve 10 to seal the container 12, as long as the flow orifice 67 is associated with a suitably large upwardly extending portion 48. If the flow orifice 67 is large, it enables a large volume of the fluid to be dispensed, even if the fluid is thick, such as shampoo, liquid soap, and ketchup.

Once the dispensing pressure is released, the natural resilience of the container 12 serves to create a vacuum within the container 12 that pulls downward on the dispensing valve body 60 and thereby returns the dispensing valve body 60 from the dispensing conformation to the sealed conformation. The pressure then serves to pull down on the exterior portion 72 of the dispensing valve body 60, moving the dispensing valve body 60 from the initial conformation to the venting conformation. In the venting conformation, described above, the valve perimeter 66 and/or the exterior portion 72 loses contact with the inner spout surface 32 and/or the retaining rim 38 of the inner flange 34. Air is able to flow through the at least one venting aperture 36 and past the dispensing valve body 60 and into the container 12 until pressure is normalized. Once there is no vacuum within the container 12, and the container 12 has returned to its original shape, the natural resilience of the dispensing valve body 60 returns the exterior portion 72 to the sealed conformation and once again prevents the fluid from leaking through the fluid dispensing valve 10.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A fluid dispensing valve for controlling the flow of a fluid through a through-conduit, the through-conduit having an inner surface, the fluid dispensing valve comprising:

a retainer having an upwardly extending plug;

a dispensing valve body bounded by an exterior surface, an interior surface, a valve perimeter, and a dispensing orifice perimeter, the dispensing valve body being shaped to fit within the through-conduit such that the dispensing orifice perimeter can fit securely around and seal against the upwardly extending plug and such that the valve perimeter can form a sealing relationship with the inner surface; and an exterior portion of the dispensing valve body, adjacent the valve perimeter, that is formed of a resilient material such that the dispensing valve body can change conformation from an initial conformation, wherein the valve perimeter is positioned securely around and sealed against the inner surface, to a venting conformation, wherein the valve perimeter is pushed out of sealing contact with the inner surface when the pressure against the exterior surface exceeds the pressure against the interior surface.

2. The fluid dispensing valve of claim 1 further comprising a means for confining the dispensing valve body within the through-conduit adjacent the retainer.

3. The fluid dispensing valve of claim 1 wherein an interior portion of the dispensing valve body, adjacent the dispensing orifice perimeter, is formed of a resilient material that can change conformation from a sealed conformation, wherein the dispensing orifice perimeter is positioned securely around and sealed against the upwardly extending plug, to a dispensing conformation, wherein the dispensing orifice perimeter is lifted out of sealing contact with the upwardly extending plug when the pressure against the interior surface exceeds the pressure against the exterior surface.

4. The fluid dispensing valve of claim 1 wherein the upwardly extending plug of the retainer includes a locking taper portion.

5. A fluid dispensing valve for controlling the flow of a fluid through a through-conduit, the through-conduit having an inner surface, the fluid dispensing valve comprising;

a retainer having an upwardly extending plug that includes a locking taper portion that forms a locking taper;

a dispensing valve body bounded by an exterior surface, an interior surface, a valve perimeter, and a dispensing orifice perimeter, the valve perimeter being shaped to form a sealing relationship with the inner surface, the dispensing orifice perimeter being shaped to fit securely around and form a locking seal against the locking taper portion of the upwardly extending plug; and a means for confining the dispensing valve body within the through-conduit adjacent the retainer.

6. The fluid dispensing valve of claim 5 wherein the locking taper is between 0.5% and 10%.

7. The fluid dispensing valve of claim 5 wherein the locking taper is between 3% and 8%.

8. The fluid dispensing valve of claim 5 wherein the upwardly extending portion includes a lead-in taper portion above the locking taper portion, the lead-in taper portion having a lead-in taper.

9. A fluid dispensing valve for controlling the flow of a fluid through a through-conduit, the through-conduit having an inner surface, the fluid dispensing valve comprising:

a retainer having an upwardly extending plug;

a dispensing valve body bounded by an exterior surface, an interior surface, a valve perimeter, and a dispensing orifice perimeter, the dispensing valve body being shaped to fit within the through-conduit such that the dispensing orifice perimeter can fit securely around and seal against the upwardly extending plug and such that the valve perimeter can form a sealing relationship with the inner surface;

a means for biasing the dispensing orifice perimeter downwardly against the upwardly extending plug;

wherein the means for biasing includes an inner flange extending inwardly from the inner surface of the through-conduit, and a plug shoulder extending upwardly from the retainer, the plug shoulder extending far enough, relative to the inner flange, so that the plug shoulder pushes the dispensing valve body against the inner flange hard enough to distort the dispensing valve body; and a means for confining the dispensing valve body within the through-conduit adjacent the retainer.

10. A fluid dispensing valve for controlling the flow of a fluid through a through-conduit, the through-conduit having an inner surface, the fluid dispensing valve comprising:

a retainer having an upwardly extending plug;

a dispensing valve body bounded by an exterior surface, an interior surface, a valve perimeter, and a dispensing orifice perimeter, the dispensing valve body being shaped to fit within the through-conduit such that the dispensing orifice perimeter can fit securely around and seal against the upwardly extending plug and such that the valve perimeter can form a sealing relationship with the inner surface;

a means for biasing the dispensing orifice perimeter downwardly against the upwardly extending plug;

wherein the upwardly extending plug includes a locking taper portion; and a means for confining the dispensing valve body within the through-conduit adjacent the retainer.

* * * * *